US012577470B2

(12) United States Patent
Leplat

(10) Patent No.: US 12,577,470 B2
(45) Date of Patent: Mar. 17, 2026

(54) INTEGRATED METHOD FOR THERMAL CONVERSION AND INDIRECT COMBUSTION OF A HEAVY HYDROCARBON FEEDSTOCK IN A REDOX CHEMICAL LOOP FOR PRODUCING HYDROCARBON STREAMS AND CAPTURING THE $CO_2$ PRODUCED

(71) Applicants: TotalEnergies OneTech, Courbevoie (FR); IFP ENERGIES NOUVELLES, Rueil-Malmaison (FR)

(72) Inventor: Sébastien Leplat, Honfleur (FR)

(73) Assignees: TotalEnergies OneTech, Courbevoie (FR); IFP ENERGIES NOUVELLES, Rueil-Malmaison (FR)

( * ) Notice: Subject to any disclaimer, the term of this patent is extended or adjusted under 35 U.S.C. 154(b) by 341 days.

(21) Appl. No.: 17/789,881

(22) PCT Filed: Dec. 28, 2020

(86) PCT No.: PCT/FR2020/052630
§ 371 (c)(1),
(2) Date: Jun. 29, 2022

(87) PCT Pub. No.: WO2021/136912
PCT Pub. Date: Jul. 8, 2021

(65) Prior Publication Data

US 2023/0057765 A1 Feb. 23, 2023

(30) Foreign Application Priority Data

Dec. 30, 2019 (FR) ..... 1915705

(51) Int. Cl.
*C10B 55/10* (2006.01)
*C10G 9/00* (2006.01)
(Continued)

(52) U.S. Cl.
CPC ..... *C10B 55/10* (2013.01); *C10G 9/005* (2013.01); *C10G 47/22* (2013.01); *C10G 47/24* (2013.01);
(Continued)

(58) Field of Classification Search
CPC ..... C10B 55/10; C10B 55/04; C10G 9/005; C10G 47/22; C10G 47/24;
(Continued)

(56) References Cited

U.S. PATENT DOCUMENTS 2,884,368 A * 4/1959 Sweeney ..... C10J 3/54 208/53
2,917,451 A * 12/1959 Leffer ..... C10G 47/30 208/147
(Continued)

FOREIGN PATENT DOCUMENTS

FR 2980258 A1 3/2013

OTHER PUBLICATIONS

International Search Report of PCT/FR2020/052630 dated Feb. 25, 2021 [PCT/ISA/210].
Written Opinion of PCT/FR2020/052630 dated Feb. 25, 2021 [PCT/ISA/237].

*Primary Examiner* — Michelle Stein
(74) *Attorney, Agent, or Firm* — Sughrue Mion, PLLC

(57) ABSTRACT

The invention relates to an integrated method for thermal conversion and indirect combustion of a heavy hydrocarbon feedstock in a redox chemical loop for producing hydrocarbon streams. The heavy hydrocarbon feedstock (1) is brought into contact with inert particles (2) in a thermal conversion zone (100). Thermal conversion in the absence of hydrogen, water vapour and a catalyst produces a first gaseous effluent of hydrocarbon compounds (4) and coke, which effluent is deposited on the inert particles (5). The latter is then burned in a redox chemical loop (200) in the
(Continued)

presence of oxygen-carrying solid particles (6). The inert particles thus flow between the thermal conversion zone (100) and a reduction zone (300) of the chemical loop while the oxygen-carrying solid particles flow between the oxidation (400) and reduction zones (300) of the chemical loop.

17 Claims, 1 Drawing Sheet

(51) Int. Cl.
*C10G 47/22* (2006.01)
*C10G 47/24* (2006.01)

(52) U.S. Cl.
CPC ..... *C10G 2300/1003* (2013.01); *C10G 2300/202* (2013.01)

(58) Field of Classification Search
CPC ..... C10G 2300/1003; C10G 2300/202; C10G 9/28; C10G 49/10; Y02P 20/129; Y02P 30/40; B01J 8/1827; B01J 8/1863; B01J 8/26; B01J 19/2405; B01J 8/0015; B01J 8/0095; B01J 8/08; B01J 8/32; B01J 19/0013; B01J 19/245; B01J 19/2465; F23C 2900/99008; F23C 6/04; F23C 10/005; F23C 10/10; F23C 10/26; F23C 10/30
See application file for complete search history.

(56) References Cited

U.S. PATENT DOCUMENTS 4,007,092 A * 2/1977 Metrailer ..... C10B 55/10 201/20
4,062,760 A * 12/1977 Blaser ..... C10G 9/32 208/127
4,077,869 A * 3/1978 Moritz ..... C10B 55/10 208/127
4,213,848 A * 7/1980 Saxton ..... C10J 3/56 208/127
4,668,378 A * 5/1987 Miyauchi ..... C10G 9/32 208/127
4,675,098 A * 6/1987 Miyauchi ..... C10G 9/32 208/127
5,284,574 A * 2/1994 Chen ..... C10G 9/32 208/126
9,707,532 B1 * 7/2017 Silverman ..... B01J 6/008
2011/0123407 A1 * 5/2011 Freel ..... C10B 53/02 422/187
2011/0132737 A1 * 6/2011 Jadhav ..... C01B 32/50 202/99
2015/0013575 A1 * 1/2015 Yazdanpanah ..... C10J 3/725 422/643
2016/0061442 A1 * 3/2016 Yazdanpanah ..... B01J 8/007 431/170
2017/0313947 A1 * 11/2017 Hoteit ..... C10G 51/04

* cited by examiner

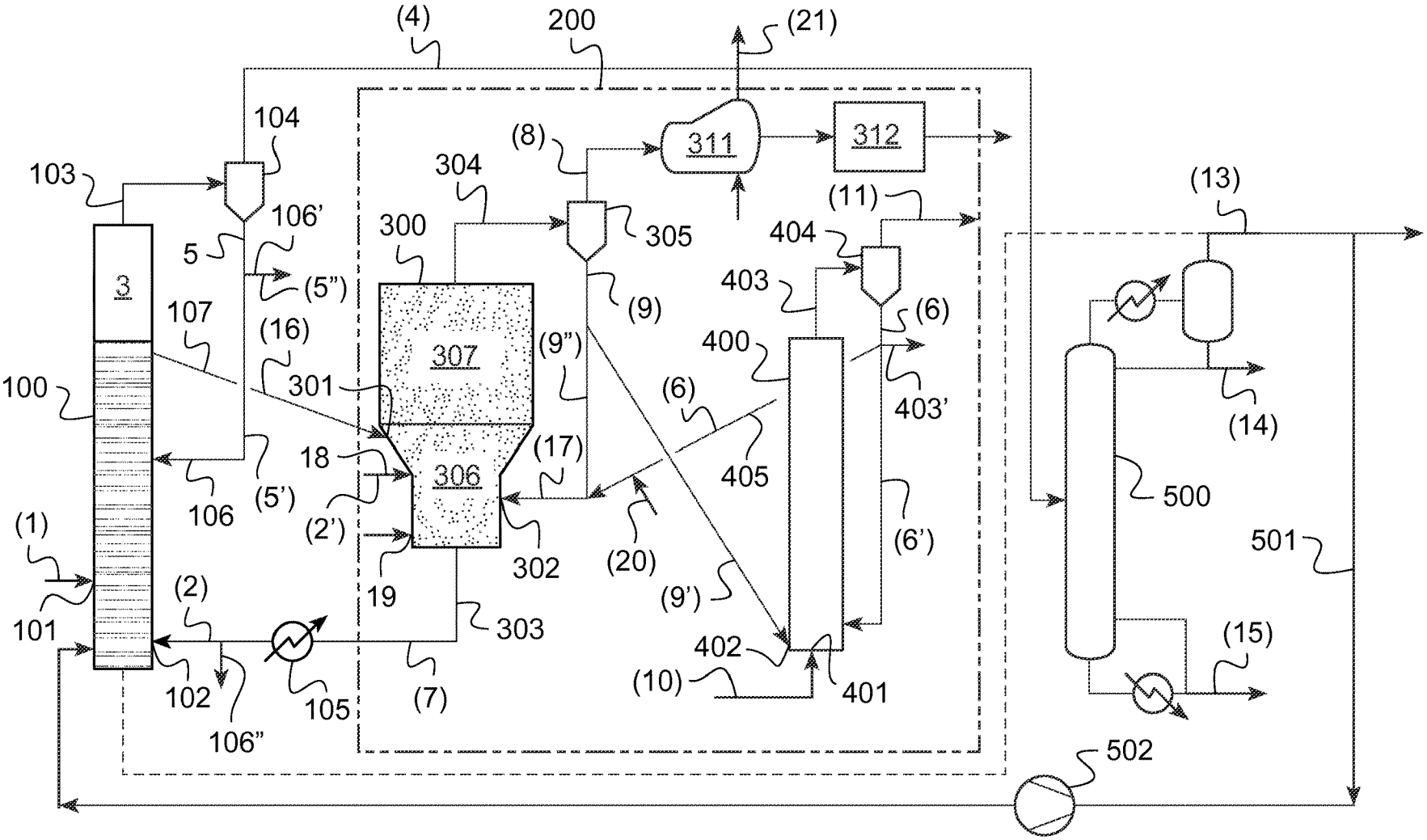
(13)
(14)
(15)
501
500
502
(21)
312
311
(11)
(6)
403'
(6')
404
403
400
405
401
402
(10)
(9')
(6)
(20)
(9)
305
200
(8)
(9")
(17)
302
303
304
307
306
(7)
(4)
300
19
301
18
(2')
105
104
106'
(5")
(16)
(5')
106"
5
107
106
(2)
102
3
103
100
(1)
101

INTEGRATED METHOD FOR THERMAL CONVERSION AND INDIRECT COMBUSTION OF A HEAVY HYDROCARBON FEEDSTOCK IN A REDOX CHEMICAL LOOP FOR PRODUCING HYDROCARBON STREAMS AND CAPTURING THE $CO_2$ PRODUCED

CROSS-REFERENCE TO RELATED APPLICATIONS

This application is a National Stage of International Application No. PCT/FR2020/052630, filed Dec. 28, 2020, claiming priority to French Patent Application No. 1915705, filed Dec. 30, 2019, the entire disclosures of which are incorporated by reference herein.

FIELD OF THE INVENTION

The subject of the invention is an integrated method for thermal conversion and indirect combustion of a heavy hydrocarbon feedstock in a redox chemical loop for producing hydrocarbon streams while capturing the gases emitted during the combustion, and more particularly $CO_2$. The invention is particularly adapted for the treatment of heavy hydrocarbon feedstocks which are not in solid form, and which contain in particular high sulphur content.

PRIOR ART

Some petroleum products are difficult to valorise due to their high sulphur content. They can nevertheless be treated by thermal conversion methods, such as catalytic cracking, thermal cracking, hydrocracking, visbreaking, pyrolysis. This type of feedstock tends to contaminate and deactivate the catalysts, requiring a frequent and costly replacement of the catalysts used in catalytic methods. Catalyst-free methods have thus been developed.

In particular, the HTL (Heavy to light) method allows treating heavy feedstocks by thermal conversion using a heat transfer fluid formed of mineral particles, the heat necessary for the conversion being provided by the flowing mineral particles.

The document U.S. Pat. No. 5,792,340 describes, for example, a method in which a feedstock undergoes a rapid thermal conversion (by pyrolysis or cracking) in a reactor by mixing and rapid heat transfer with a stream of hot inorganic solid particles (sand) injected into the reactor. The particles are then separated from the conversion products, heated (for example by combustion of the coke deposited thereon during the thermal conversion), then reinjected into the reactor.

The documents US2004069682A1 or US2004069686A1 describe a rapid thermal conversion method (pyrolysis) of a heavy feedstock in the presence of heat-transfer inorganic particles and a compound containing calcium. The heat-transfer inorganic particles (for example sand) are then separated from the conversion products and regenerated before being returned to the thermal conversion zone. The presence of a calcium-based compound allows in particular reducing nitrogen oxide emissions.

Certain methods allow limiting the production of $CO_2$. The document WO2014140175A1 thus describes a thermal cracking method in which the heat required for the cracking is supplied by mineral particles and combustion gases originating from a regenerator. The feedstock (heavy, very heavy feedstock or bitumen) is converted into gas and coke which is deposited on the mineral particles. The coked mineral particles are entrained with the gases originating from the converted feedstock and regenerated in the regenerator before being returned with the combustion gases into the thermal cracking zone, while the converted gases are condensed then fractionated.

Most of the methods, however, leave ultimate residues, such as coke, which can be little or not valorised and emit flue gases containing carbon dioxide ($CO_2$) in substantial amount.

For all industrial sectors, greenhouse gases and in particular $CO_2$ are considered pollutants whose emissions need to be controlled and reduced.

In particular, in the field of refining, many methods emit, during operation, of flue gases containing $CO_2$, including the previously mentioned thermal conversion methods. Most often, the capture of $CO_2$ is carried out by a treatment which consists in separating the $CO_2$ from the other constituent elements of these flue gases, for example by chemical absorption by a liquid solvent, generally an amine. After absorption in a first column, the solvent flows in a regeneration column where the modification of the pressure and temperature conditions (heating) allows desorbing the $CO_2$ and "regenerating" the solvent. This heating is generally ensured by water vapour and constitutes an energy-intensive step.

The capture by chemical absorption is the most widely used method, in particular because it allows obtaining a good compromise between the capture rate and the purity of the recovered $CO_2$. However, there are other $CO_2$ separation techniques, such as the use of membranes, cryogenic distillation and adsorption.

Flue gas treatment can however be costly in terms of energy when it comes to separating $CO_2$ from nitrogen, as for example in the flue gases from the combustion installations. It is then possible to use other capture techniques, more specifically of separation, of $CO_2$. Oxy-combustion is a method which allows producing energy while capturing $CO_2$ generated during the combustion. It consists in burning the fuel with pure oxygen or oxygen-enriched air. As a result, the combustion gas will mainly contain $CO_2$ and water which can be easily separated and recovered. This method involves the recirculation of combustion flue gases and their mixing upstream of the hearth with oxygen to control and limit the combustion temperature. The costliest step in terms of energy is the production of oxygen upstream, which itself generates $CO_2$. There are alternative methods, such as "chemical looping combustion" or CLC, for which the oxygen is supplied chemically. The CLC method also allows producing energy while capturing $CO_2$.

The CLC method consists in breaking down the combustion reaction into two successive reactions. A first oxidation reaction of an active mass, with air or a gas playing the role of combustive, allows oxidising the active mass. A second reduction reaction of the active mass thus oxidised using a reducing gas then allows obtaining a reusable active mass as well as a gaseous mixture essentially comprising $CO_2$ (generally more than 90% vol., even 98% vol.) and water, or even synthesis gas containing dihydrogen and nitric oxide. This technique therefore allows isolating $CO_2$ or the synthesis gas in a gaseous mixture practically devoid of oxygen and nitrogen, thus facilitating the separation and recovery of $CO_2$ or synthesis gas. The active mass, passing alternately from its oxidised form to its reduced form and vice versa, describes an oxidation-reduction cycle. Thus, in the reduction reactor, the active mass ($M_xO_y$), where M is a metal, is first of all reduced to the state $M_xO_{y-2n-m/2}$, via a hydrocarbon $C_nH_m$ (n, m, x and y being non-zero integers), which is correlatively oxidised to $CO_2$ and $H_2O$, according to reaction (1), or optionally to a $CO+H_2$ mixture depending on the used proportions.

$$C_nH_m+M_xO_y \rightarrow n\ CO_2+m/2H_2O+M_xO_{y-2n-m/2} \quad (1)$$

In the oxidation reactor, the active mass is restored to its oxidised state ($M_xO_y$) in contact with air according to reaction (2), before returning to the first reactor.

$$M_xO_{y-2n-m/2}+(n+m/4)O_2 \rightarrow M_xO_y \quad (2)$$

Both oxy-combustion and the CLC method thus allows producing energy, and not hydrocarbon streams, while capturing $CO_2$.

The document U.S. Ser. No. 10/125,323 describes a processing method in which a heavy feedstock is subjected to a cracking reaction in a reactor in the presence of metal oxides in order to form cracking products and coke deposited on the metal oxides. The latter are then sent to a reduction reactor of a CLC loop in which the coke is gasified in the presence of water vapour, producing a synthesis gas and metal oxides in the reduced state. The latter are partly returned to the cracking reactor and partially sent to an oxidation reactor of the CLC loop to be reoxidised therein before being returned to the reduction reactor. The implementation of this method can however be problematic. Indeed, if the coke is not well burned, the metal oxides will be difficult to re-oxidise, which will limit the combustion of the coke to the following cycle and will again generate difficulties in oxidising the reduced metal oxides.

DESCRIPTION OF THE INVENTION

In order to overcome all or part of the aforementioned drawbacks, a method for thermal conversion of a petroleum feedstock into lighter hydrocarbon products is proposed, this method producing little or no ultimate hydrocarbon residue, allowing a capture of the produced $CO_2$.

Definitions

By "inert particles", we mean chemically inert (solid) particles under the usual reaction conditions, in other words particles which are not likely to undergo chemical modifications or to catalyse chemical reactions.

By "hydrocarbon feedstock" or "hydrocarbon stream", we mean a mixture of hydrocarbon compounds, a hydrocarbon compound containing carbon and hydrogen, and optionally heteroatoms such as sulphur, nitrogen, metals . . .

By "non-entrained bed", we mean a bed of particles whose level is controlled in order to maintain a constant bed height.

By "particle fines" we mean particles whose average diameter has been reduced by abrasion, due to the friction of the particles against each other, in other words by attrition. Such particles therefore have an average diameter which is less than the average diameter of the particles before attrition.

By "average diameter" we mean the diameter of a spherical particle of the same mass. This average diameter can be determined by any appropriate technique, in particular by the optical diffraction techniques (for example by laser diffraction).

Downstream and upstream refer to the directions of flow of the fluids within the different zones of the installation.

SUMMARY OF THE INVENTION

A first object of the invention relates to a method for converting a heavy hydrocarbon feedstock into a lighter hydrocarbon stream and coke by thermal conversion and coke conversion by combustion in a redox chemical loop in which:

- a thermal conversion of the heavy hydrocarbon feedstock is carried out in a thermal conversion zone by bringing it into contact with hot inert particles to produce, in the absence of dioxygen and a catalyst, optionally in the presence of water vapour and/or dihydrogen, a first gaseous effluent of hydrocarbon compounds and coke, the latter being deposited on the inert particles,
- the coked inert particles are discharged from the thermal conversion zone and are sent to a reduction zone of a redox chemical loop in which particles of an oxygen-carrying solid flow,
- a combustion of the coke deposited on the discharged coked inert particles is carried out in the reduction zone to produce a second gaseous effluent, hot inert particles at least partially freed from coke and oxygen-carrying solid particles in the reduced or partially reduced state, the oxygen-carrying solid particles in the reduced or partially reduced state forming a bed located above a bed formed by the inert particles in the reduction zone,
- the oxygen-carrying solid particles in the reduced or partially reduced state are discharged from the reduction zone and at least partially returned to an oxidation zone of the chemical loop to oxidise them by means of an oxidising gas before reintroducing them into the reduction zone,
- the hot inert particles which are at least partially freed from coke are discharged from the reduction zone and at least partially returned to the thermal conversion zone, the energy necessary for the thermal conversion reaction being at least partially provided by the exothermic combustion of all or part of the coke in the reduction zone.

In the method according to the invention, two distinct streams of particles are thus flowing: a first stream of particles formed of hot inert particles circulates between the thermal conversion zone and the reduction zone of the redox chemical loop and a second particle stream formed of oxygen-carrying solid particles flows between the reduction zone and the oxidation zone of the chemical loop. The inert particles thus act as a heat transfer fluid. In particular, inside the reduction zone, the oxygen-carrying solid particles and the inert particles flow counter-current, the oxygen-carrying solid particles typically flowing from bottom to top.

During the thermal conversion step, for example a thermal cracking, a hydrocarbon stream is thus produced containing products which are lighter than the heavy hydrocarbon feedstock to be treated.

Furthermore, the coke, ultimate residue of the thermal conversion, is burnt in the reduction zone of the thermal loop. The combustion of coke thus allows providing the energy required for the thermal conversion of the heavy feedstock. In addition, the coke combustion method does not require a costly oxygen supply but uses the oxygen-carrying solid particles.

Thus, the method according to the invention as a whole does not produce any ultimate residue and allows producing a hydrocarbon stream of interest while capturing the generated combustion gases, such as $CO_2$, at lower operating cost.

The oxygen-carrying solid particles in the reduced or partially reduced state form a bed located above a bed formed by the inert particles in the reduction zone. To this end, the method may have one or more of the following features:

a particle size of the oxygen-carrying solid particles which is sufficiently lower than that of the inert particles, for example lower by a factor from 1 to 1000, 100 to 1000, 1 to 10 or 1 to 2, or by a factor comprised within a range defined by any two of these limits, in particular such that the oxygen-carrying solid particles are lighter than the inert particle, an appropriate choice of the average diameter of the particles, in particular such that the oxygen-carrying solid particles are lighter than the inert particles, for example an average diameter from 50 μm to 2 mm or from 50 μm to 500 μm, an appropriate choice of the density of the oxygen carrier particles and the inert particles, in particular such as the oxygen-carrying solid particles are lighter than the inert particles, for example a density from 1500 to 6000 km/m$^3$ or from 1500 to 5000 kg/m$^3$, an appropriate choice of the hydrodynamic conditions of the reduction zone, in particular of a superficial velocity of a fluidisation gas of the reduction zone from 30 to 300% of the terminal average fall velocity of the inert particles, from 50 to 100% or from 75 to 125%.

Advantageously, the combustion of the coke in the reduction zone can be total, which allows producing a second gaseous effluent concentrated in $CO_2$, containing in particular 90% vol or more of $CO_2$.

Advantageously, it is possible to recover the second gaseous effluent produced in the reduction zone and separated it from the oxygen-carrying solid particles in the reduced or partially reduced state.

The second gaseous effluent can then be cooled in at least one heat exchanger by heat exchange with a fluid, for example water in liquid form. Optionally, the heated fluid can be used to generate thermal or electrical energy. The energy of the combustion gases can thus be recovered and valorised.

Advantageously, the hot inert particles can form a non-entrained bed in the thermal conversion zone passed through by the flowing heavy feedstock, in particular from bottom to top. This allows making a good contact with the hot feedstock and facilitating the recovery of the coked inert particles which do not need to be separated from the first effluent, which is for example recovered above the non-entrained bed.

Advantageously, the first gaseous effluent originating from the thermal conversion zone can be subjected, optionally directly, to fractionation in a fractionation zone, optionally after separation of coked inert particle fines, in particular directly after this separation. It is thus possible to separate the different hydrocarbon constituents of the first effluent, for a direct subsequent use or after an additional treatment. In particular, sending the first gaseous effluent directly to the fractionation zone (possibly directly after separation of the fines) allows benefiting from the heat of the first effluent exiting the thermal conversion zone to carry out the fractionation, thus limiting the energy to be supplied to carry out the fractionation.

In particular, the fractionation zone can separate the first gaseous effluent at least into an incondensable gaseous fraction and a liquid fraction, preferably into at least one incondensable gaseous fraction, one condensable gaseous fraction and one liquid fraction.

Optionally, at least one portion of said incondensable gaseous fraction can be sent to the thermal conversion zone, in particular to improve the hydrodynamic conditions and therefore the performance in terms of conversion of the heavy feedstock.

Advantageously, the oxygen-carrying solid particles in the reduced or partially reduced state, originating from the reduction zone and separated from the second effluent, can be partially recycled in the reduction zone to continue the conversion of the coke.

Advantageously, the hot inert particles, which are at least partially freed from coke, can be cooled before they are returned to the thermal conversion zone in at least one heat exchanger by heat exchange with a fluid, for example water in liquid form. This can allow regulating the temperature of the hot inert particles returned to the thermal conversion zone.

Advantageously, the second gaseous effluent, after separation of the oxygen-carrying solid particles in the reduced or partially reduced state, optionally after cooling, can be subjected to at least one purification treatment, in particular to remove possibly present impurities such as dust, nitrogen oxides (NOx), sulphur oxides (SOx), carbon monoxide (CO). The purification treatment(s) can be carried out in one or several purification zones.

Advantageously, the oxidising gas used in the oxidation zone of the thermal loop is air, such that it is not necessary to supply the method with costly oxygen whose production generates $CO_2$.

Advantageously, the oxidising gas reduced during the re-oxidation of the oxygen-carrying solid particles can be separated from the solid particles of the re-oxidised oxygen carrier, then subjected to at least one purification treatment, in particular to remove the possibly present impurities such as dust, nitrogen oxides, sulphur oxides, carbon monoxide. The purification treatment(s) can be carried out in one or several purification zones, preferably distinct from those possibly provided for the treatment of the second gaseous effluent.

The heavy hydrocarbon feedstock treated by the method according to the invention may be selected from hydrocarbon feedstocks with high sulphur content, atmospheric residues, vacuum residues, alone or in combination.

The method according to the invention is particularly adapted for the treatment of heavy petroleum products, and in particular the petroleum distillation residues, the effluents originating from thermal conversion methods, catalytic cracking methods, hydrocracking methods, deep hydroconversion methods, methods for hydrotreating atmospheric residues or under vacuum (ARDS or VRDS) or even fuel oils originating from mixtures of heavy products.

The heavy hydrocarbon feedstock can be a mixture of heavy hydrocarbon compounds with a boiling temperature greater than or equal to 350° C., denoted 350° C.+. In particular, the method according to the invention is suitable for the treatment of heavy hydrocarbon feedstocks with a high sulphur content, namely having a sulphur content greater than or equal to 0.5% m (mass), 1% m, 1.5% m, 2% m, 3% m, or more.

The invention is not adapted for treating heavy solid hydrocarbon feedstocks of the coke, coal or coked catalyst type originating from a fluidised bed catalytic cracking (FCC) method.

The invention also relates to an installation for converting a heavy hydrocarbon feedstock for implementing the method according to the invention.

This installation comprises at least:

one thermal conversion reaction zone, devoid of supply of dioxygen and catalyst, optionally equipped with a supply of water vapour and/or dihydrogen, comprising a supply of heavy hydrocarbon feedstock, a supply of hot inert particles, a first conduit for discharging a first gaseous effluent comprising hydrocarbon compounds and a second conduit for discharging coked inert particles, the first discharge conduit being optionally equipped with a first gas-solid separation device to separate the first gaseous effluent from the coked inert particle fines, one redox chemical loop comprising a reduction zone and an oxidation zone in which particles of an oxygen-carrying solid flow.

According to the invention, the reduction zone comprises a supply of coked inert particles connected to the second conduit for discharging hot coked inert particles connected to the second conduit for discharging coked inert particles from the thermal conversion zone, a supply of oxygen-carrying solid particles originating from the oxidation zone, a conduit for discharging the inert particles, which are at least partially freed from coke, connected to the supply of inert particles of the thermal conversion zone, a conduit for discharging the oxygen-carrying solid particles in the reduced or partially reduced state.

According to the invention, the oxidation zone comprises a supply of oxidising gas, a supply of oxygen-carrying solid particles in the reduced or partially reduced state connected to the discharge conduit of the reduction zone and a conduit for discharging the re-oxidised oxygen-carrying solid particles connected to the supply of oxygen-carrying solid particles of the reduction zone.

The installation may include one or more of the following features:

a second gas-solid separation device for separating a second gaseous effluent from the oxygen-carrying solid particles in the reduced or partially reduced state located on the conduit for discharging the oxygen-carrying solid particles in the reduced or partially reduced state from the reduction zone, a third gas-solid separation device for separating the reduced oxidising gas exiting the oxidation zone from the re-oxidised oxygen-carrying solid particles located on the conduit for discharging the re-oxidised oxygen-carrying solid particles from the oxidation zone.

a fractionation zone supplied with the first gaseous effluent originating from the thermal conversion zone, optionally downstream of the first gas-solid separation device, the fractionation zone being optionally equipped with a conduit for recycling an incondensable gaseous fraction supplying the thermal conversion zone, a conduit for recycling oxygen-carrying solid particles in the reduced or partially reduced state originating from the second gas-solid separation device to the supply of the reduction zone, one or more heat exchangers selected from a heat exchanger to cool the second gaseous effluent originating from the second gas-solid separation device and a heat exchanger to cool the recycled inert particles in the thermal conversion zone, at least one purification system to purify the second gaseous effluent originating from the second gas-solid separation device, optionally downstream of said at least one heat exchanger, at least one other system for purifying the reduced oxidising gas originating from the third gas-solid separation device.

DETAILED DESCRIPTION OF THE INVENTION

Thermal Conversion of the Heavy Hydrocarbon Feedstock

The thermal conversion reaction of the heavy hydrocarbon feedstock takes place in the thermal conversion zone, in the absence of dioxygen and a catalyst, in which the feedstock is brought into contact with inert particles producing a first gaseous effluent which can then be discharged and coke which is deposited on the inert particles.

This first step is similar to the thermal conversion carried out in the previously mentioned HTL method.

It will be noted that the thermal conversion reaction can be carried out in the presence of dihydrogen, which can allow stabilising the conversion products and further desulphurising the feedstock. It will then be possible to recover the unconsumed dihydrogen, for example by fractionating the first gaseous effluent.

These inert particles can for example be selected from silica or any other heat transfer material, preferably of a hardness equivalent to silica in order to avoid the formation of fines. It is possible, for example, to use magnesium oxides, aluminium oxides, copper oxides or the like.

Inside the thermal conversion zone, the feedstock to be treated flows, preferably through a bed of inert particles whose level is controlled. In other words, in normal operation, the inert particles are not entrained with the first gaseous effluent but form a non-entrained bed.

The feedstock to be treated can for example flow from bottom to top, in one or more reactors of the riser type. It is first vaporised before being converted into gas leaving the reaction zone at the top and into coke deposited on the inert particles. The coked inert particles leave the thermal conversion zone by withdrawal, preferably in the vicinity of the top of the bed of inert particles.

Alternatively, the inert particles could also flow from the thermal conversion zone to the reduction zone of the thermal loop and vice versa, using for example the circulating fluidised bed technology. In this case, coked inert particles are recovered at the outlet (for example in the upper zone) of the thermal conversion zone mixed with the first effluent from which they are separated therefrom by the first gas-solids separation device before being sent to the reduction zone.

Under the operating conditions of the method according to the invention, namely at atmospheric pressure, at a temperature advantageously ranging from 450 to 600° C., preferably from 480° C. to 550° C. (limits included).

In general, the contact time between the feedstock to be treated and the hot inert particles in the reaction zone can be from a few seconds to several minutes, for example 5 seconds to 10 minutes.

In general, the ratio of inert particles/feedstock to be treated inside the thermal conversion zone could be determined by those skilled in the art depending on the residence times of the feedstock.

The thermal conversion produces coke and hydrocarbon compounds which are lighter than those initially contained in the heavy hydrocarbon feedstock.

The gaseous hydrocarbon stream produced by thermal conversion generally contains a liquid fraction forming synthetic olefinic crude oil (also called "syncrude" or "synthetic crude") and a valuable gaseous fraction containing many olefins.

The performance of the thermal conversion can be controlled in the usual manner by monitoring the flow rate of the feedstock to be treated, the temperature of the inert particles entering the reaction zone, the ratio of the flow rate of feedstock to be treated/flow rate of inert particles entering the reaction zone, the hydrodynamic conditions. The hydrodynamic conditions can in particular be improved via the injection of one or more of the following fluids: incondensable gaseous fraction from the fractionation of the first gaseous effluent, water vapour, dihydrogen.

When the feedstock to be treated includes compounds containing heteroatoms (sulphur, nitrogen, metals), the latter are deposited on the inert particles during the thermal conversion. Thus, despite the absence of a catalyst, the method allows reducing the nitrogen, sulphur and metal contents of the converted feed.

At the outlet of the thermal conversion zone, a first gaseous effluent of hydrocarbon compounds, coke and inert particles is thus recovered, the coke (and possibly the nitrogen, the sulphur and/or the metals) being deposited on the latter. The first gaseous effluent is then recovered, in particular at the top of the reaction zone, optionally after separation of coked inert particle fines in a gas-solid separation device comprising for example one or more cyclonic separation devices. The coked inert particles are on their side discharged from the reaction zone and sent, in particular directly, in the reduction zone of the chemical loop to be partially or completely freed from coke therein, and optionally from the sulphur and/or the nitrogen possibly present, before being returned to the thermal conversion zone for a new cycle.

The inert particles thus flow continuously between the thermal conversion zone and the reduction zone of the redox chemical loop.

Since the thermal conversion reaction is endothermic, the necessary energy is provided at least partially by the exothermic combustion of all or part of the coke produced in the redox chemical loop, via the at least partially decoked inert particles exiting the reduction area of the redox chemical loop and entering the thermal conversion zone.

During the different cycles, the inert particles can be disaggregated by attrition. They can also become increasingly loaded with metals, even unburnt coke. Provision can then be made to regularly subtract a portion thereof, for example before their introduction into the reduction zone of the thermal loop, in particular at the outlet of the thermal conversion zone, and to add new ones thereto, for example before they enter the thermal conversion zone. It is also possible by this means to control the heat generated in the reduction zone or brought into the thermal conversion zone.

The temperature of the inert particles originating from the reduction zone of the thermal loop and entering the thermal conversion zone can also be regulated by means of one or more heat exchangers disposed on the conduit transporting the inert particles from the chemical loop to the thermal conversion zone.

Coke Combustion Reaction in Chemical Loop

The redox chemical loop combustion installation comprises an oxidation zone and a reduction zone. Oxygen-carrying solid particles flow from one reaction zone to another, using for example the circulating fluidised bed technology using a fluidising gas. The oxygen-carrying solid particles can thus pass continuously from one zone to another.

The oxygen-carrying solid is oxidised by an oxidising gas, generally air, in an oxidation zone comprising at least one fluidised bed at a temperature generally ranging from 700 to 1200° C., preferably from 800 to 1000° C. It is then transferred to a reduction zone comprising at least one fluidised bed reactor where it is brought into contact with the fuel (herein the coke deposited on the inert particles, the latter possibly containing, in addition to carbon, nitrogen, sulphur, hydrogen, metals) at a temperature generally ranging from 800 to 1200° C., preferably from 900 to 1100° C. The contact time typically varies between 10 seconds and 10 minutes, preferably from 1 to 5 minutes. The oxygen-carrying solid is then again transferred to the oxidation zone.

The ratio between the flowing active mass and the amount of oxygen to be transferred between the two reaction zones can advantageously be from 20 to 100.

Usable oxygen-carrying solid particles are generally composed of a redox couple or a set of redox couples selected from CuO/Cu, $Cu_2O$/Cu, NiO/Ni, $Fe_2O_3/Fe_3O_4$, FeO/Fe, $Fe_3O_4$/FeO, $MnO_2/Mn_2O_3$, $Mn_2O_3/Mn_3O_4$, $Mn_3O_4$/MnO, MnO/Mn, $Co_3O_4$/CoO, CoO/Co, and often a binder providing a physico-chemical stability.

Many types of binders can be used, such as yttrium-stabilized zirconia, also called yttria zirconia (YSZ), alumina, metal aluminate spinels, titanium dioxide, silica, zirconia, kaolin or else a ceria-zirconia type binder. The redox couple/binder mass ratio is generally around 60/40 in order to obtain particles having a good mechanical resistance as well as sufficient redox properties (rate of oxidation, reduction and oxygen transfer capacity).

It is also possible to use ilmenite ore ($FeTiO_3$) or else catalysts based on spent silica and alumina impregnated with metal salts, preferably based on iron, nickel, copper, cobalt or manganese, as described in FR2930733B1, these catalysts come from fluidised bed catalytic cracking installations.

The coke deposited on the inert particles is thus introduced into the reduction zone in which it is oxidised by the oxygen-carrying solid which is in an oxidised state when it is introduced into the reduction zone. The maximum oxygen capacity which is actually available can vary considerably depending on the nature of the oxygen-carrying solid, and is generally comprised from 0.1 to 15% by mass, and often from 0.3 to 6% by mass.

In the reduction zone, the combustion of the coke can be partial or total, preferably total in order to produce a second effluent rich in $CO_2$, namely containing 90% vol. or more of $CO_2$. A partial combustion with production of dihydrogen is however possible.

In the case of total combustion, the gas flow at the outlet of the reduction reactor is essentially composed of $CO_2$ and water vapour (namely containing 90% vol. or more of $CO_2$ and water vapour), or even of $NO_2$ and $SO_2$, the metals remaining on the inert particles. A $CO_2$ stream ready to be sequestered is then obtained by condensation of water vapour.

In the case of partial combustion, the active mass/fuel ratio can be adjusted so as to carry out the partial oxidation of the fuel, producing a synthesis gas in the form of a $CO+H_2$ mixture. The method can therefore be used for the production of synthesis gas. Furthermore, the produced CO can then be converted into $CO_2$ via the well-known technologies.

In the case where the used fluidising gas is water vapour or a mixture of water vapour and other gas(es), the reaction of the CO gas with water (or water gas shift, $CO+H_2O \rightarrow CO_2+H_2$) can also take place, resulting in the production of a $CO_2+H_2$ mixture at the reactor outlet. In this case, the combustion gas can be used for power generation purposes considering its calorific value. It is also possible to consider using this gas for the production of dihydrogen, for example to supply hydrogenation, hydrotreating units in refining or a dihydrogen distribution network (after the water gas shift reaction).

Depending on the use of the combustion gases, the pressure of the method will be adjusted. Thus, in order to perform a total combustion, it will be advantageous to work at low pressure to minimise the energy cost of gas compression and thus maximise the energy efficiency of the installation. In order to produce synthesis gas by partial combustion, it is possible advantageously in certain cases to work under pressure, in order to avoid the compression of the synthesis gas upstream of the downstream synthesis method: the Fischer Tropsch method working for example at pressures comprised between 20 and 40 bars, it may be of interest to produce the gas at a higher pressure.

It will be noted that when metals are deposited on the inert particles during the thermal conversion, the latter remain on the particles at the outlet of the reduction zone. It may then be necessary to withdraw the inert particles loaded with metals from the flow and to inject new inert particles.

On the contrary, sulphur and nitrogen are respectively transformed into sulphur oxides and nitrogen oxides in the reduction zone and are discharged with the second effluent.

The particle size of the oxygen-carrying solid particles is selected sufficiently smaller than the particle size of the inert particles such that the oxygen-carrying solid particles float above the inert particles in the fluidised bed of the reduction zone. In other words, two distinct beds of particles are formed, the lower bed comprising essentially (namely more than 80% by mass) inert particles, the upper bed comprising essentially oxygen-carrying solid particles. This allows recovering the oxygen-carrying solid particles in the upper portion of the reduction zone mixed with the second gaseous effluent, and the inert particles in the lower portion of the reduction zone. The latter are then returned to the supply of the thermal conversion zone.

Advantageously, in general, two distinct beds of particles can be obtained by selecting particles of different particle size, possibly with oxygen-carrying solid particles which are lighter than inert particles (in the absence of coke), and hydrodynamic conditions appropriate in the reduction zone. Oxygen-carrying solid particles which are lighter than inert particles (in the absence of coke) can be obtained by an appropriate selection of the particle size of the particles depending on the density of the material constituting them, it nevertheless remains preferable to provide a particle size of the oxygen-carrying solid particles which is lower than the particle size of the inert particles. Typically, oxygen-carrying solid particles and inert particles having a density of 500 to 6000 kg/m$^3$, preferably of 1500 to 5000 kg/m$^3$ and an average diameter of 50 μm to 2 mm, or even 50 μm to 500 μm. In particular, the average diameter of the oxygen-carrying solid particles might then be less than the average diameter of the inert particles by a factor of 1 to 1000, or even of 100 to 1000, preferably of 1 to 10, more often of 1 to 2, or a factor within a range defined by any two of these limits. The value 1 could be excluded from these different ranges. The person skilled in the art will be able to select the average diameters and densities of these particles in these ranges and appropriate hydrodynamic conditions in order to obtain two distinct beds of particles: a bed of oxygen-carrying solid particles and, under this, a layer of inert particles.

Appropriate hydrodynamic conditions can be obtained by a superficial velocity of the gaseous fluid flowing from bottom to top depending on the terminal average fall velocity of the inert particles sufficient to separate the heavy inert particles from the lighter oxygen-carrying solid particles. This gaseous fluid flowing from bottom to top is the fluidising gas of the reduction zone and can be formed from the combustion gases (in other words the second effluent of the present invention, injected at the bottom of the reduction zone via a recycling conduit), water vapour or a mixture of the two. The superficial velocity of the gaseous fluid, in particular for particles in previously mentioned ranges of average diameter and density, might be set at a value ranging from 30 to 300% of the terminal average fall velocity of the inert particles, preferably from 50 to 150%, more preferably from 75 to 125%. The person skilled in the art will know how to determine the superficial velocity of the fluidising gas of the reduction zone depending on the average diameter and the density of the different particles and in particular the difference in mass of these particles and/or the difference in particle size. Each of the abovementioned ranges for the average diameter, the density, the mass difference and the average diameter difference can be combined with one or more of the other ranges of one or more of these features.

The terminal average fall velocity of the inert particles is obtained from the following formula (3):

$$Vt = \left(\frac{4d_p(\rho_s - \rho_g)g}{3\rho_g C_D}\right)^{1/2} \tag{3}$$

$d_p$ is the average diameter of the particles
$\rho_s$ is the density of the particles (kg/m$^3$)
$\rho_g$ is the density of the gaseous fluid (kg/m$^3$)
$C_D$ is the drag coefficient
g, acceleration due to the force of gravity (m/sec$^2$).

Advantageously, the oxygen-carrying solid particles originating from the oxidation zone are introduced into the reduction zone in a lower portion thereof below the introduction of the inert particles. In other words, the oxygen-carrying solid particles in the oxidised state enter the reduction zone upstream of the inlet of the coked inert particles originating from the thermal conversion zone relative to their flow direction. This allows promoting the contact between the two types of particles and the reduction of the coke, in particular by a counter-current circulation of the coked inert particles, which flow from top to bottom, and of the oxygen carrier particles, the latter flowing from bottom to top. This counter-current circulation can be promoted by the injection of the fluidising gas (water vapour and/or combustion gas) flowing from bottom to top, this injection being advantageously carried out below the introduction of the oxygen-carrying solid particles.

In particular, the introduction of the coked inert particles originating from the thermal conversion zone can preferably be carried out at the head of the lower bed.

Advantageously, the decoked inert particles (at least partially) can be withdrawn from the bottom of the reduction zone to be returned to the thermal conversion zone.

Advantageously, the oxygen carrier particles may be of micron-sized and the inert particles can be millimetre-sized. The difference in size between the two types of particles can thus be from 100 to 1000, however, it is possible to select particles whose average diameter differs by a factor from 1 to 1000, preferably from 1 to 10, most often from 1 to 2, or by a factor within a range defined by any two of the aforementioned limits. The value 1 could be excluded from these different ranges. Such a difference in size promotes the separation into two beds, in particular when the hydrodynamic conditions are fulfilled, namely in particular when the fluidising gas progresses from bottom to top.

The oxygen-carrying solid particles totally or partially reduced following the oxidation of the coke are thus found in the upper portion of the reduction zone from which they are discharged.

The oxygen-carrying solid particles are generally discharged mixed with the second gaseous effluent. They can then be separated from the latter in a second gas-solid separation device, comprising for example one, two or more cyclonic separation devices, preferably at least three.

The oxygen-carrying solid particles thus recovered can then either be sent in their entirety to the oxidation zone, or be sent in part to the oxidation zone and the remainder to the inlet of the reduction zone to continue the reduction of coke.

The second gaseous effluent essentially contains carbon dioxide and water (namely 90% vol. or more of $CO_2$ and water), in particular when the combustion is total. It may also contain dust, nitrogen oxides and sulphur oxides, which can be removed by an appropriate treatment in one or more purification systems. By way of example, it is possible for example to use condensation systems to recover water and possibly NOx or SOx, systems for reducing NOx (called DeNox), systems for reducing SOx (DeSox), dust removal systems (use of filters, electrofilters, etc.), systems for converting residual CO into $CO_2$. Provision may be made to recover the heat from the second gaseous effluent by means of one or more heat exchangers, preferably located upstream of the purification system(s). Such purification treatments allow separating/recovering the $CO_2$, in other words capturing it, with a view to its subsequent use, these separations/recoveries being facilitated due to the high contents of the second effluent in $CO_2$ produced during a total combustion.

In the oxidation zone, the oxygen-carrying solid particles are re-oxidised, at least partially, preferably entirely, by the oxidising gas. Advantageously, they are introduced in the lower portion of the oxidation zone as well as the oxidising gas, usually air. They are then recovered in the upper portion of the oxidation zone, for example mixed with the oxygen-depleted air from which they can then be separated in a third gas-solid separation device, such as for example one or more cyclonic separation devices. The oxygen-depleted air can then be purified to remove any impurities such as dust. The recovered re-oxidised oxygen-carrying solid particles are then reinjected into the reduction zone, preferably in the lower portion thereof, under the introduction of the inert particles. Optionally, a portion of the re-oxidised oxygen-carrying solid particles can be reinjected into the oxidation zone in order to continue their oxidation.

During the different cycles, the oxygen-carrying solid particles can disaggregate by attrition: it may then be provided to regularly subtract a portion therefrom, for example after their exit from the oxidation zone, in particular after their separation from the air, and to add new ones, for example at the inlet of the oxidation zone or upstream of this inlet.

Fractionation of the First Gaseous Effluent

The first gaseous effluent exiting the thermal conversion zone, after possible separation of coked inert particle fines, can be used directly or be treated.

In one preferred embodiment, the first gaseous effluent, after separation of the coked inert particles, can advantageously be sent to a fractionation zone in order to recover and separate several fractions of hydrocarbon compounds.

This fractionation zone can comprise one or more distillation columns selected from a distillation column under atmospheric pressure and a vacuum distillation column, preferably an atmospheric pressure distillation column.

The fractionation can advantageously allow separating at least one incondensable gaseous fraction and one liquid fraction.

In one embodiment, the fractionation can allow separating at least one incondensable gaseous fraction, a condensable gaseous fraction and a liquid fraction.

The incondensable gaseous fraction can comprise gases such as methane, ethane, propane, butane, dihydrogen sulphide, olefins (ethylene, propylene, butene . . . ), etc., mainly methane, ethane, propane and dihydrogen sulphide. These gases can advantageously be partially sent to the conversion zone to improve the hydrodynamic conditions.

The condensable gaseous fraction can comprise hydrocarbons which include at least 5 carbon atoms, for example 5 to 35 carbon atoms). It can be mixed with the liquid fraction.

A portion of the condensable gaseous fraction, in particular the heaviest portion, can be recycled in charge of the thermal conversion to produce more gas and middle distillates.

The liquid fraction can form a syncrude, which can be sent to conventional refining treatments if necessary. This liquid fraction can also be fractionated into several cuts (naphtha, middle distillate, atmospheric residue).

These different fractions can then optionally be subjected to subsequent conventional refining or synthesis treatments according to the desired use.

DESCRIPTION OF FIGURES

The invention is now described with reference to the appended, non-limiting drawings, in which:

FIG. 1 represents an exemplary embodiment of an installation implementing the method according to the invention.

In the FIGURE, the references relating to flowing fluids are in parentheses.

In a first step, the heavy hydrocarbon feedstock 1, for example a petroleum product with a high sulphur content, is subjected to a thermal conversion in a reaction zone 100, herein a non-entrained fluidised bed reactor, in the presence of hot inert particles 2. To this end, the reaction zone 100 comprises a supply 101 of heavy hydrocarbon feedstock 1 and a supply 102 of hot inert particles 2. The heavy hydrocarbon feedstock 1 and the hot inert particles 2 are introduced in the lower portion of the reaction zone 100. The hot inert particles 2 form a non-entrained bed 3 of constant height. The supply 101 of heavy hydrocarbon feedstock 1 is herein located above the supply 102 of hot inert particles 2. In contact with the hot inert particles 2 at high temperature, the heavy hydrocarbon feedstock 1 undergoes a thermal conversion, generating a gaseous effluent 4 (called first gaseous effluent in the following) progressing vertically upwards in the reaction zone 100 and coke being deposited on the hot inert particles 2. Generally, the heavy hydrocarbon feedstock 1 is introduced inside of the reaction zone 100 via injectors spraying it.

The reaction zone 100 also comprises a conduit 103 for discharging the first gaseous effluent 4 essentially consisting of hydrocarbon compounds most often mixed with coked inert particle fines 5. The discharge conduit 103, located in the upper portion of the reaction zone 100, is equipped with a first gas-solid separation device 104 to separate the first gaseous effluent 4 from coked inert particle fines 5. By way of example, the first gas-solid separation device 104 can comprise two cyclones.

The coked inert particle fines 5 are discharged from the system (5") via the conduit 105, but a portion can be recycled (5') to the reaction zone 100 via a conduit 106 opening into the bed 3 of inert particles. The coked inert particles 16 are discharged from the reaction zone 100 via the conduit 107. The conduit 107 herein withdraws the coked inert particles 16 from an upper portion, in particular from the top, of the bed 3 of inert particles inside the reaction zone 100. The coke deposited on the surface of the coked inert particles 16 is then burned in a chemical loop 200 which comprises a reduction zone 300 and an oxidation zone 400.

The reduction zone 300, herein a fluidised bed reactor, comprises a supply 301 of coked inert particles 16 originating from the reaction zone 100, a supply 302 of oxygen-carrying solid particles in the oxidised state 17 partially originating from the oxidation zone 400 and a gas-solid separator 305, a conduit 303 for discharging the inert particles at least partially freed from coke 7, which form at least one portion of the hot inert particles 2 entering the thermal conversion zone 100.

The reduction zone 300 also comprises a conduit 304 for discharging oxygen-carrying solid particles in the reduced or partially reduced state mixed with a second gaseous effluent 8, rich in $CO_2$ and $H_2O$ when the combustion is total. This discharge conduit 304 is equipped with a second gas-solid separation device 305 to separate the second gaseous effluent 8 from the oxygen-carrying solid particles in the reduced or partially reduced state 9.

The supply 302 of oxygen-carrying solid particles in the oxidised state 17 is located in the lower portion of the reduction zone 300, under the supply 301 of coked inert particles 16. This promotes a counter-current of the coked inert particles 16 and the oxygen carrier particles in the oxidised state 17 in order to carry out the coke combustion. A fluidising gas, herein water vapour, is injected via a supply 19 provided under the supplies 301 and 302. The difference in particle size between these particles, the gas generated by the coke combustion and/or the injection of water vapour via the supply 19 allow this counter-current movement and the formation of two beds of particles:

- a lower bed 306 composed essentially of inert particles passed through by the oxygen-carrying solid particles in the oxidised state 17 transferring their oxygen for the coke combustion.
- an upper bed 307 composed essentially of oxygen-carrying solid particles in the reduced or partially reduced state 9.

A supply 18 of the reduction zone 300 (located herein under the supply 301 of coked inert particles and above the supply 302 of oxygen-carrying solid particles in the oxidised state 17) allows topping up with inert particles 2' (loss by attrition withdrawn in 106' or subtraction from the installation via the conduit 106"). The invention is however not limited to this position of the supply of fresh inert particles 2', nor to these positions of the extractions of used/degraded inert particles.

The conduit 303 for discharging the mostly decoked inert particles 7, returns the latter to the supply 102 of the thermal conversion zone 100. This discharge conduit 303 is herein located at the bottom of the reduction zone 300. A heat exchanger 105 allows controlling the temperature at which the inert particles join the thermal conversion zone 100.

The oxidation zone 400, herein a fluidised bed reactor, comprises a supply 401 of oxidising gas 10, a supply 402 of oxygen-carrying solid particles in the reduced or partially reduced state 9' originating from the second separation device 305 and a conduit 403 for discharging the oxygen-carrying solid particles in the oxidised or partially oxidised state 6.

In the example, this discharge conduit 403 is equipped with a third gas-solid separation device 404 for the separation of the oxygen-carrying solid particles in the oxidised or partially oxidised state 6 and oxidising gas whose oxygen content is lowered 11. The flow of oxygen-carrying solid particles in the oxidised or partially oxidised state 6 is partially or totally returned, in mixture with a portion of the reduced or partially reduced oxygen-carrying solid particles 9", towards the reduction zone 300 via a conduit 405 connected to the supply 302. A portion 6' of the oxygen-carrying solid particles in the oxidised state 6 can also be returned to the inlet of the oxidation zone in order to continue their oxidation. In order to maintain the capacity of the oxygen-carrying solid particles to transfer oxygen, a portion of the particles at equilibrium can be withdrawn from the system (via the conduit 403') and a topping up with fresh particles (20) can be made, for example upstream of the reduction zone 300.

The oxidising gas generally being air, the oxidising gas whose oxygen content is lowered 11 is then air enriched in nitrogen. This air flow enriched in dinitrogen 11 can optionally be sent to a subsequent purification treatment.

The represented installation further comprises a fractionation zone 500 supplied with the first gaseous effluent 4 from the thermal conversion zone 100. The fractionation zone 500 is herein a distillation column under atmospheric pressure.

At the outlet of the fractionation zone, is recovered an incondensable gaseous fraction 13, a condensable gaseous fraction 14 and a liquid fraction 15. The distillation column can possibly be equipped with additional withdrawals to produce middle distillate cuts and a residue (or distillation bottom). The sulphur content of the different liquid fractions will be significantly lower than that of the feedstock 1. Depending on the sulphur content of the starting feedstock, some cuts may be valorised as marine fuel with a sulphur content of less than 0.5% m. At a minimum, the distillation column will produce an incondensable gas fraction 13 and a liquid fraction (syncrude) by mixing fractions 14 and 15. The incondensable gaseous fraction 13 could be partially recycled to the reaction zone 100 to improve the hydrodynamic conditions and therefore the performance in terms of conversion of the heavy feedstock 1. To this end, a compressor 502 might be provided on the conduit 501 recycling a portion of the incondensable gaseous fraction 13 to the reaction zone 100.

The represented installation herein comprises a heat exchanger 311 used to cool the second gaseous effluent 8 and produce water vapour 21 on the utility side which could be valorised either as a heat transfer fluid, or to generate electricity via a turbine. The represented installation finally comprises a purification system 312 for condensing water and subtracting the SOx and the NOx, or even dedusting the flow and/or converting the possibly produced CO (in the case of incomplete combustion of the coke) into $CO_2$, thus producing a concentrated $CO_2$ stream which can be transported and used or stored.

The invention claimed is:

1. A method for converting a heavy hydrocarbon feedstock into a lighter hydrocarbon stream and coke by thermal conversion and coke conversion by combustion in a redox chemical loop wherein:

- a thermal conversion of the heavy hydrocarbon feedstock is carried out in a thermal conversion zone by bringing it into contact with hot inert particles to produce, in the absence of dioxygen and a catalyst, optionally in the presence of water vapour and/or dihydrogen, a first gaseous effluent of hydrocarbon compounds and coke, the latter being deposited on the inert particles, the first gaseous effluent of hydrocarbon compounds and the coked inert particles are separated, the separated coked inert particles are discharged from the thermal conversion zone and are sent to a reduction zone of a redox chemical loop in which particles of an oxygen-carrying solid flow, wherein the oxygen-carrying solid particles comprise a redox couple or a set of redox couples selected from the group consisting of CuO/Cu, $Cu_2O$/Cu, NiO/Ni, $Fe_2O_3$/$Fe_3O_4$, FeO/Fe, $Fe_3O_4$/FeO, $MnO_2$/$Mn_2O_3$, $Mn_2O_3$/$Mn_3O_4$, $Mn_3O_4$/MnO, MnO/Mn, $Co_3O_4$/CoO, and CoO/Co, a combustion of the coke deposited on the discharged coked inert particles is carried out in the reduction zone to produce a second gaseous effluent, hot inert particles at least partially freed from coke and oxygen-carrying solid particles in the reduced or partially reduced state, a particle size of the oxygen-carrying solid particles is sufficiently lower than that of the inert particles to allow the oxygen-carrying solid particles in the reduced or partially reduced state to form a bed located above a bed formed by the inert particles in the reduction zone, the oxygen-carrying solid particles in the reduced or partially reduced state are discharged from the reduction zone separately from the hot inert particles and at least partially returned to an oxidation zone of the chemical loop to oxidise them by means of an oxidising gas before reintroducing them into the reduction zone, the hot inert particles which are at least partially freed from coke are discharged from the reduction zone separately from the oxygen-carrying solid particles and at least partially returned to the thermal conversion zone, the energy necessary for the thermal conversion reaction being at least partially provided by the exothermic combustion of all or part of the coke in the reduction zone.

2. The method according to claim 1, wherein the second gaseous effluent produced in the reduction zone is recovered and separated from the oxygen-carrying solid particles in the reduced or partially reduced state.

3. The method according to claim 2, wherein the second gaseous effluent, produced in the reduction zone and separated from the oxygen-carrying solid particles in the reduced or partially reduced state, is cooled in at least one heat exchanger by heat exchange with a fluid, and, optionally, the heated fluid is used to generate thermal or electrical energy.

4. The method according to claim 1, wherein the hot inert particles form a non-entrained bed in the thermal conversion zone passed through by the flowing heavy feedstock.

5. The method according to claim 1, wherein the first gaseous effluent originating from the thermal conversion zone is subjected, optionally directly, to fractionation in a fractionation zone, optionally after separation of coked inert particle fines.

6. The method according to claim 5, wherein the fractionation zone separates the first gaseous effluent at least into an incondensable gaseous fraction and a liquid fraction, and, optionally, at least one portion of said incondensable gaseous fraction is returned to the thermal conversion zone.

7. The method according to claim 1, wherein the oxygen-carrying solid particles in the reduced or partially reduced state originating from the reduction zone and separated from the second effluent, are partially recycled in the reduction zone.

8. The method according to claim 1, wherein the hot inert particles, which are at least partially freed from coke, are cooled before they are returned to the thermal conversion zone in a heat exchanger by heat exchange with a fluid.

9. The method according to claim 1, wherein at least one fluid selected from:

the second gaseous effluent after separation of the oxygen-carrying solid particles in the reduced or partially reduced state and optionally after cooling, the oxidising gas reduced during the re-oxidation of the oxygen-carrying solid particles after separation of the re-oxidised oxygen-carrying solid particles, is subjected to a purification treatment.

10. The method according to claim 1, wherein the heavy hydrocarbon feedstock is selected from hydrocarbon feedstocks with high sulphur content, atmospheric residues, vacuum residues, alone or in combination.

11. The method according to claim 1, comprising one or more of the following features:

a particle size of the oxygen-carrying solid particles which is lower by a factor from 1 to 1000 than that of the inert particles, an average diameter of the oxygen-carrying solid particles and inert particles from 50 μm to 2 mm, a density of oxygen-carrying solid particles and inert particles from 500 to 6000 $kg/m^3$, a superficial velocity of a fluidisation gas of the reduction zone from 30 to 300% of the terminal average fall velocity of the inert particles.

12. An installation for converting a heavy hydrocarbon feedstock for implementing the method according to claim 1, comprising at least:

one thermal conversion reaction zone, devoid of supply of dioxygen and catalyst, optionally equipped with a supply of water vapour and/or dihydrogen, comprising a supply of heavy hydrocarbon feedstock, a supply of hot inert particles, a first conduit for discharging a first gaseous effluent comprising hydrocarbon compounds and a second conduit for discharging coked inert particles, the first discharge conduit being optionally equipped with a first gas-solid separation device to separate the first gaseous effluent from the coked inert particle fines, one redox chemical loop comprising a reduction zone and an oxidation zone in which particles of an oxygen-carrying solid flow, the reduction zone comprising a supply of hot coked inert particles connected to the second conduit for discharging coked inert particles from the thermal conversion zone, a supply of oxygen-carrying solid particles originating from the oxidation zone, a conduit for discharging the inert particles, which are at least partially freed from coke, connected to the supply of hot inert particles of the thermal conversion zone, a conduit for discharging the oxygen-carrying solid particles in the reduced or partially reduced state, the supply of oxygen-carrying solid particles being located in the lower portion of the reduction zone, under the supply of coked inert particles, a particle size of the oxygen-carrying solid particles is sufficiently lower than that of the inert particles to allow the oxygen-carrying solid particles in the reduced or partially reduced state to form a bed located above a bed formed by the inert particles in the reduction zone, and the conduit for discharging the inert particles discharges said inert particles from the lower bed and the conduit for discharging the oxygen-carrying solid particles in the reduced or partially reduced state discharges said oxygen-carrying solid particles in the reduced or partially reduced state from the upper bed, and the oxidation zone comprising a supply of oxidising gas, a supply of oxygen-carrying solid particles in the reduced or partially reduced state connected to the discharge conduit of the reduction zone and a conduit for discharging the re-oxidised oxygen-carrying solid particles connected to the supply of oxygen-carrying solid particles of the reduction zone, wherein the oxygen-carrying solid particles comprise a redox couple or a set of redox couples selected from the group consisting of CuO/Cu, $Cu_2O$/Cu, NiO/Ni, $Fe_2O_3/Fe_3O_4$, FeO/Fe, $Fe_3O_4$/FeO, $MnO_2/Mn_2O_3$, $Mn_2O_3/Mn_3O_4$, $Mn_3O_4$/MnO, MnO/Mn, $Co_3O_4$/CoO, and CoO/Co.

13. The installation according to claim 12, comprising at least one of the following features:

a second gas-solid separation device for separating a second gaseous effluent from the oxygen-carrying solid particles in the reduced or partially reduced state located on the conduit for discharging the oxygen-carrying solid particles in the reduced or partially reduced state from the reduction zone, a third gas-solid separation device for separating the reduced oxidising gas exiting the oxidation zone from the re-oxidised oxygen-carrying solid particles located on the conduit for discharging the re-oxidised oxygen-carrying solid particles from the oxidation zone.

14. The installation according to claim 13, comprising a conduit for recycling oxygen-carrying solid particles in the reduced or partially reduced state originating from the second gas-solid separation device to the supply of the reduction zone.

15. The installation according to claim 12, comprising one or more heat exchangers selected from a heat exchanger to cool the second gaseous effluent originating from the second gas-solid separation device and a heat exchanger to cool the recycled inert particles in the thermal conversion zone.

16. The installation according to claim 13, comprising at least one of the following features:

at least one purification system to purify the second gaseous effluent originating from the second gas-solid separation device, optionally downstream of said at least one heat exchanger, at least one other system for purifying the reduced oxidising gas originating from the third gas-solid separation device.

17. The installation according to claim 12, further comprising a fractionation zone supplied by the first conduit for discharging the first gaseous effluent from the thermal conversion zone, optionally downstream of the first gas-solid separation device, the fractionation zone being optionally equipped with a conduit for recycling an incondensable gaseous fraction supplying the thermal conversion zone.

* * * * *